United States Patent [19]

Delaplace

[11] B 3,985,084

[45] Oct. 12, 1976

[54] GRATING WITH PUSH BARS FOR AN INCINERATOR

[75] Inventor: Lucien Delaplace, Sevres, France

[73] Assignee: Stein Industrie, Velizy Villacoublay, France

[22] Filed: Oct. 4, 1974

[21] Appl. No.: 512,324

[44] Published under the second Trial Voluntary Protest Program on February 17, 1976 as document No. B 512,324.

[30] Foreign Application Priority Data

Oct. 9, 1973 France ..... 73.36004

[52] U.S. Cl. ..... 110/8 R; 110/37; 110/38

[51] Int. Cl.[2] ..... F23G 5/00; F22B 1/22

[58] Field of Search ..... 110/8 R, 18 R, 37, 38

[56] References Cited

UNITED STATES PATENTS

| | | | |
|---|---|---|---|
| 1,211,755 | 1/1917 | Reagan | 110/38 |
| 3,055,320 | 9/1962 | Bolda | 110/8 X |
| 3,413,938 | 12/1968 | Dvirka | 110/38 |
| 3,541,978 | 11/1970 | Stloukal et al. | 110/38 |

FOREIGN PATENTS OR APPLICATIONS

| | | | |
|---|---|---|---|
| 911,316 | 5/1954 | Germany | 110/38 |

*Primary Examiner*—Kenneth W. Sprague
*Attorney, Agent, or Firm*—Haseltine, Lake & Waters

[57] ABSTRACT

A grating for an incinerator of combustible waste comprising a plurality of parallel juxtaposed bars disposed transversely in the incinerator and extending lengthwise thereof to provide a support surface on which waste is advanced in the course of its combustion. The bars are arranged in two sets alternating with one another, the bars of one set being fixed and the bars of the second set being reciprocally movable. The bars of the one set are secured at gradually lowered positions in the incinerator to provide a downward inclination of about 15° with the horizontal in the lengthwise direction of advancement of the waste. The bars of both sets are inclined with the horizontal at an angle of about 30° in a direction opposite the downward inclination in the lengthwise direction. The bars of the second set are reciprocally movable in a direction parallel to their inclination and neighboring movable bars are connected by a linkage for movement in opposite direction, whereas neighboring coupled pairs of movable bars are driven conjointly.

10 Claims, 5 Drawing Figures

GRATING WITH PUSH BARS FOR AN INCINERATOR

BACKGROUND

The present invention relates to a grating having push bars in the combustion chamber of an incinerator for the burning of combustible waste; such a grating comprises push bars disposed in parallel fashion and identical to one another and of two types, one being fixed and forming aligned steps extending the length of said chamber and having a general slope in the direction of advancement and descent of said waste, the other type alternating with the first and having a small play therewith and being reciprocally movable.

The present invention relates particularly to the magnitude of slope of the bars themselves and to the relative movements of the movable bars with respect to the others.

Gratings used for the combustion of a homogeneous carbon product can not be utilized for the combustion of domestic waste which is particularly heterogeneous. Such waste is of low calorific power, has a high moisture content, contains a large quantity of inert materials, and has foreign heteroclite bodies all of which complicate the problem of the regular combustion of such waste. It has already been proposed to provide a grating having bars with steps more or less strongly inclined with respect to the horizontal and disposed along a generally descending slope.

It has been stated in the utilization of stepped bars, horizontal or not, with a general slope whatever, that the stirring of the waste was insufficient.

SUMMARY OF THE INVENTION

An object of the present invention is to provide a grating construction which avoids the disadvantages of the known constructions.

This is achieved by a construction in which, on the one hand, the bars are inclined in a direction opposite the general slope of the fixed bars so as to retain the lower part of the waste layer, and on the other hand, two neighboring bars are driven in opposite direction so that while one is pushing against the lower portion of the waste layer, and displaces a given volume, the other bar is being retracted by an equal volume.

The result is that the waste layer is subjected to a stirring and grinding action and a renewing of the surface thereof in contact with the combustion air.

These new arrangements for the structure of the grating and for the movement of its movable bars constitute the principal features of the present invention, of which the essential factor consists, on the one hand, in that the bars of both types are inclined at an angle of about 30° to the horizontal and in a direction opposite to the general downward slope of the fixed bars which is about 15°; and on the other hand, by displacement of the movable bars parallel to their inclination and in a manner in which neighboring movable bars move in opposite directions.

Other characteristics and advantages of the invention will appear more clearly from the following description of one embodiment given by way of example and with reference to the appended drawing.

DETAILED DESCRIPTION

Figure 1:
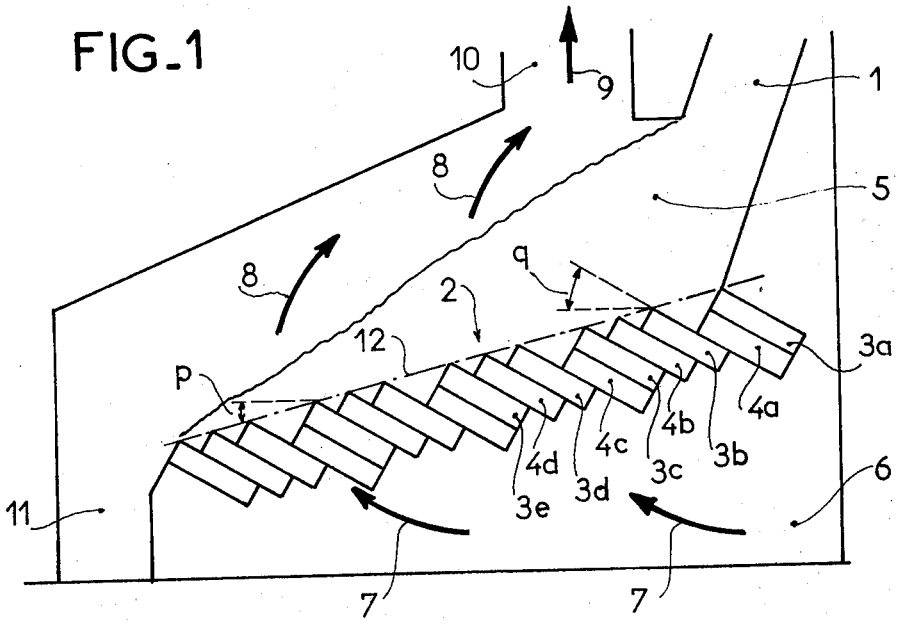
FIG. 1 is a schematic longitudinal section taken through an incinerator provided with a grating according to the invention.

Referring to FIG. 1, waste to be incinerated is introduced into a chute 1 of the chamber of an incinerator where it reaches the first elements of a grating 2. According to the invention, the grating is constituted by fixed bars 3*a*, 3*b*, 3*d*, 3*e*, etc. alternating with movable bars 4*a*, 4*b*, 4*c*, 4*d*, etc. schematically represented as rectangular.

In the course of incineration, the waste forms a layer 5 while undergoing combustion with air introduced, under pressure, in chamber 6 in the direction of the arrows 7 to traverse the grating 2 and contact layer 5. The combustion gas or exhaust gas released from layer 5 travels in the direction of arrows 8 and leaves the furnace in the direction of arrow 9 through the stack 10.

The operation of the incinerator is as follows: At the entrance, the waste reaches the movable bar 4*a* in lowered position. This is then raised to advance the waste along the length of the step or landing formed by bar 3*b* while the subsequent movable bar 4*b* undergoes a reverse movement, i.e. it is retracted by an amount equal to that of the displacement of bar 4*a* to permit the fall and the return of the waste driven in movement by bar 4*a*. Therefore, step by step the waste of the layer 5 is successively lifted by the movable bars 4*b*, 4*c*, 4*d*, etc. while passing successively on the steps 3*c*, 3*d*, 3*e*, etc.

The continuous changing of the part of the waste in contact with the grating permits a total utilization of the waste leading to the combustion which is continuous, regular and complete.

The ash and refuse of the burned waste descends to the lower extremity of the grating 2 and drop into an outlet chute 11 leading to a cleanser (not represented).

The residence time of the waste in the incinerator chamber and the rate of utilization substantially depend on the average slope of the travel path of the waste, i.e. the angle $p$ with the horizontal of broken line 12 connected to the high points of the fixed bars. This angle is reverse that of the landings of the bars which form an angle $q$ with the horizontal i.e. the angle along which the movable bars 4*a*, 4*b*, etc. effect their alternating movement.

The relation of these two angles is one of the important parameters of the grating according to the invention. It has been found that a satisfactory operation is obtained when $p$ and $q$ are of the order, respectively, of 15° and 30°, and the optimal value of the relation $p/q$ is of the order 0.5.

Figure 2:
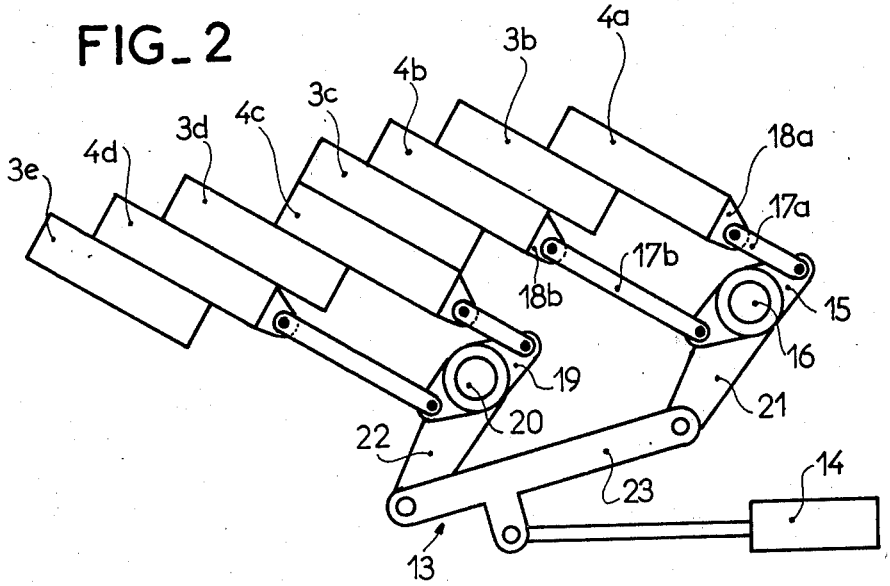
FIG. 2 is a view, on enlarged scale, of the drive mechanism of two neighboring pairs of mobile grate bars.

In FIG. 2, the four mobile bars 4*a*, 4*b*, 4*c*, 4*d* associated with fixed bars 3*b*, 3*c*, 3*d*, and 3*e* are controlled by a mechanism 13 driven by a hydraulic jack 14. The mobile bar 4*a* is displaced above the bar 3*b*, whereas the mobile bar 4*b* is displaced above the bar 3*c*. These two displacements are effected in reverse order with respect to one another. The two neighboring mobile bars 4*a* and 4*b* form a coupled pair and their movement in reverse directions is effected by connecting them to a rocker arm 15 turnable on a shaft 16.

Rods 17*a* and 17*b* are connected at one end to bars 4*a* and 4*b* via respective gussets 18*a* and 18*b*, and at their other ends are pivotably connected to the rocker arm 15 at symmetrically opposed locations with respect to shaft 16.

The bars 4*c* and 4*d* are coupled as a pair to a rocker arm 19 turnable around a shaft 20.

The rocker arms 15 and 19 of the two coupled pairs are driven in rotation around their respective shafts 16 and 20 by means of links 21 and 22 joined to a lever 23 controlled by the jack 14. There is thus provided an independent drive mechanism for four neighboring movable bars associated in pairs. This permits adaptation of the amplitude, speed and frequency of movements of the bars of each group to variations of the thickness and of the density of the layer of waste in proportion to its advancement in the chamber, i.e. as a function of the position of said groups on the grating.

Figure 3:
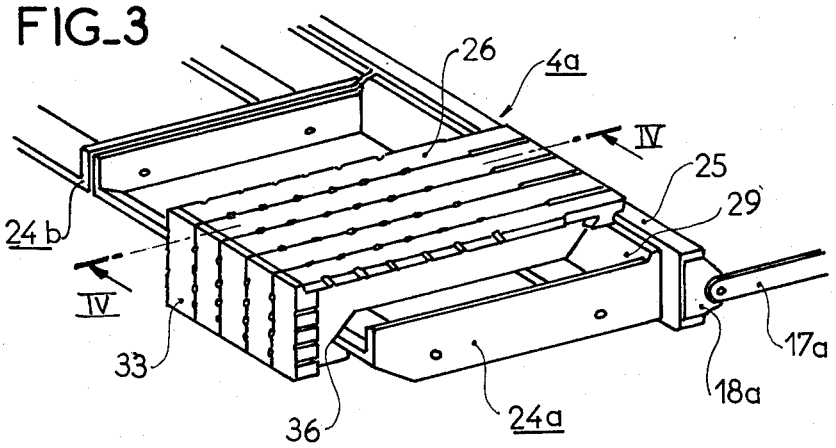
FIG. 3 is a perspective view of a portion of a mobile grate bar having a plurality of connected, divided boxes.

In FIG. 3, the mobile bar 4*a* comprises boxes 24*a*, 24*b* secured to one another at their lateral faces and mounted together at their rear face to a beam 25 provided with gussets 18*a* pivotably connected to drive rods 17*a*. In each divided box are mounted dismountable elongated members 26 collectively forming the step surface of the associated bar. The fixed bars 3*a*, 3*b*, etc. have the same structure as the mobile bars but are fixed to the frame of the incinerator, (instead of being slidably mounted as are mobile bars).

Figure 4:
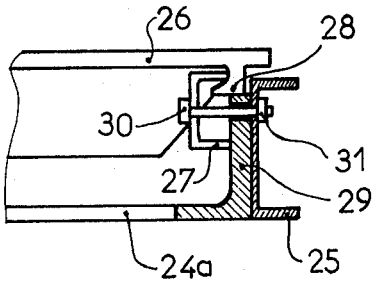
FIG. 4 is a portion of a cross-section taken along line Iv—IV in FIG. 3.

In FIG. 4, the member 26 is secured to the box 24*a* by a clamp 27 engaging a hook 28 on rod 26 to press the hook against the rear flange 29 of the box 24*a*. The clamp 27 is locked by a screw 30 threaded via nut 31 and supported in beam 25.

Figure 5:
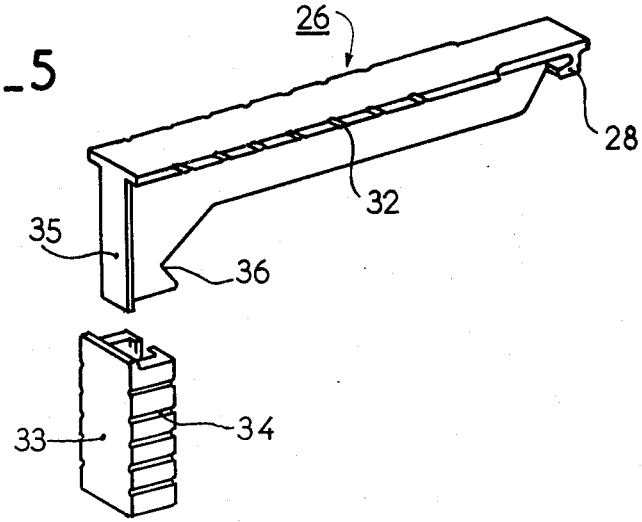
FIG. 5 is an exploded perspective view, on enlarged scale, of a portion of a grate bar.

In FIG. 5, it is seen that the member 26 is provided with lateral notches 32 suitably inclined for the passage of air through the grating. At the front of member 26, there is mounted a protection member 33, provided with lateral notches 34 for passage of air, member 33 being slidably mounted on a guide 35, in order to eliminate play between successive movable and fixed bars in to which could be introduced waste elements capable of blocking, by wedging, any of the mobile bars. The members 26 themselves are mounted on the boxes 24 at a single point of rear attachment by the hook 28 while the mounting at the front is effected by engagement of angular surface 36 at the bottom of member 26 with a complementary corresponding surface at the front of box 24.

From the above, it is seen that the invention contemplates a grating construction comprising a plurality of parallel juxtaposed bars disposed transversely in the incinerator and extending lengthwise thereof to provide a support surface on which waste is advanced in the course of combustion thereof, the bars being arranged in two sets alternating with one another, the bars 3*a*, 3*b*, etc. of one set being fixed and the bars 4*a*, 4*b*, etc. of the second set being reciprocally movable, the bars of said one set being secured at gradually lowered positions in the incinerator to provide a downward inclination $p$ of about 15° with the horizontal in the lengthwise direction of advancement of the waste, said bars of both sets being inclined with the horizontal at an angle $q$ of about 30° in a direction opposite said downward inclination in the lengthwise direction.

The bars 4*a*, 4*b* of the second set are reciprocally movable in a direction parallel to their inclination and neighboring bars are connected by a linkage means 15, 16, 17*a*, 17*b* for movement in opposite directions conjointly by drive mechanism 13.

Although the invention has been described with reference to a specific embodiment, numerous modifications thereof may be made within the scope and spirit of the invention as defined by the appended claims.

What is claimed is:

1. A grating for an incinerator of combustible waste comprising a plurality of parallel juxtaposed bars disposed transversely in the incinerator and extending lengthwise thereof to provide a support surface on which waste is advanced in the course of combustion thereof, said bars being arranged in two sets alternating with one another, the bars of one set being fixed and the bars of the second set being reciprocally movable, the bars of said one set being secured in successive gradually lowered positions in the incinerator to provide a downward inclination of about 15° with the horizontal in the lengthwise direction of advancement of the waste, said bars of both sets being inclined with the horizontal at an angle of about 30° in a direction opposite said downward inclination in the lengthwise direction.

2. A grating as claimed in claim 1 wherein said bars of the second set are reciprocally movable in a direction parallel to their inclination, said grating further comprising linkage means connecting neighboring bars of the second set in pairs for movement in opposite directions and drive means connecting neighboring pairs of bars for conjoint movement.

3. A grating as claimed in claim 2, wherein said linkage means comprises a rocker arm for each pair of bars of said second set pivotable about a central axis, and links connected to the rocker arms and to respective neighboring bars of the second set.

4. A grating as claimed in claim 3, wherein said links are connected to each said rocker arm at symmetrical positions with respect to said central axis thereof.

5. A grating as claimed in claim 4, wherein said drive means further comprises a pivotal lever connected to the rocker arms of neighboring pairs of bars of the second set and a hydraulic jack connected to said pivotal lever to pivotably move the same whereby the four neighboring bars of the pair of the second set are conjointly driven in respectively opposite direction.

6. A grating as claimed in claim 2, wherein each said bar comprises a plurality of divided boxes laterally secured to one another, each divided box including a plurality of adjoining elongated members, and a common beam to which the elongated members of said boxes are fixed.

7. A grating as claimed in claim 6, wherein each said common beam of each movable bar of the second set is connected to the drive means for such bar.

8. A grating as claimed in claim 7, comprising clamping means attaching the elongated members of said divided boxes of each bar to said common beam, each elongated member having an inclined bearing surface, remote from said clamping means, by which said elongated member is supported in its respective box.

9. A grating as claimed in claim 8, wherein said elongated members are provided with notches for passage of air therethrough.

10. A grating as claimed in claim 9, comprising removable safety elements engaging each elongated member on a side thereof remote from said clamping means, said safety elements also being provided with notches for passage of air therethrough.

* * * * *